US012768163B2

(12) United States Patent
Shen et al.

(10) Patent No.: US 12,768,163 B2
(45) Date of Patent: Oct. 20, 2026

(54) WALL ANCHOR

(71) Applicants: Po-Han Shen, Taichung City (TW); Arthur Liao, Randolph, MA (US)

(72) Inventors: Po-Han Shen, Taichung City (TW); Arthur Liao, Randolph, MA (US)

( * ) Notice: Subject to any disclaimer, the term of this patent is extended or adjusted under 35 U.S.C. 154(b) by 261 days.

(21) Appl. No.: 18/823,473

(22) Filed: Sep. 3, 2024

(65) Prior Publication Data

US 2026/0062915 A1 Mar. 5, 2026

(51) Int. Cl.
*B21K 23/04* (2006.01)
*E04B 1/76* (2006.01)

(52) U.S. Cl.
CPC ..... *E04B 1/7637* (2013.01)

(58) Field of Classification Search
CPC ..... E04B 1/7637
See application file for complete search history.

(56) References Cited

U.S. PATENT DOCUMENTS 4,502,825 A * 3/1985 Yamada ..... F16B 31/021 411/910
9,091,291 B2 * 7/2015 Andrade de Souza ..... F16B 41/005
2007/0125036 A1 * 6/2007 Schloemer ..... E04B 1/762 52/698
2020/0001350 A1 * 1/2020 Hohmann, Jr. ..... E04B 1/7616

* cited by examiner

*Primary Examiner* — Amy J. Sterling
(74) *Attorney, Agent, or Firm* — MUNCY, GEISSLER, OLDS & LOWE, P.C.

(57) ABSTRACT

A wall anchor is provided, including: a main body and a sleeve member. The main body extends in a rod shape and includes a head portion, a body portion and a radial flange located between the head portion and the body portion, the body portion has an outer threaded segment, and the radial flange has a non-circular cross-sectional profile. The sleeve member includes a first portion and a second portion, the first portion is coveringly disposed on an outer surface of the head portion, and the second portion is coveringly disposed on an outer surface of the radial flange and has a circular cross-sectional profile.

10 Claims, 4 Drawing Sheets

WALL ANCHOR

BACKGROUND OF THE INVENTION

Field of the Invention

The present invention relates to a wall anchor.

Description of the Prior Art

In an existed external wall insulation system, an insulation board is mounted outside a cement wall or steel frames of a building by a plurality of self-tapping screws so as to block heat exchange between indoor and outdoor of the building. However, the plurality of self-tapping screws penetrate through the insulation board and several gaps are formed between the insulation board and the plurality of self-tapping screws, which causes heat and moisture to leak from the gaps, and the plurality of self-tapping screws are also prone to rust and aging.

The present invention is, therefore, arisen to obviate or at least mitigate the above-mentioned disadvantages.

SUMMARY OF THE INVENTION

The main object of the present invention is to provide a wall anchor, which provides heat insulation and moisture-proof effects and is durable to use.

To achieve the above and other objects, the present invention provides a wall anchor, including: a main body and a sleeve member. The main body extends in a rod shape and includes a head portion, a body portion and a radial flange located between the head portion and the body portion, the body portion has an outer threaded segment, and the radial flange has a non-circular cross-sectional profile. The sleeve member includes a first portion and a second portion, the first portion is coveringly disposed on an outer surface of the head portion, and the second portion is coveringly disposed on an outer surface of the radial flange and has a circular cross-sectional profile.

The present invention will become more obvious from the following description when taken in connection with the accompanying drawings, which show, for purpose of illustrations only, the preferred embodiment(s) in accordance with the present invention.

DETAILED DESCRIPTION OF THE PREFERRED EMBODIMENTS

Figure 1:
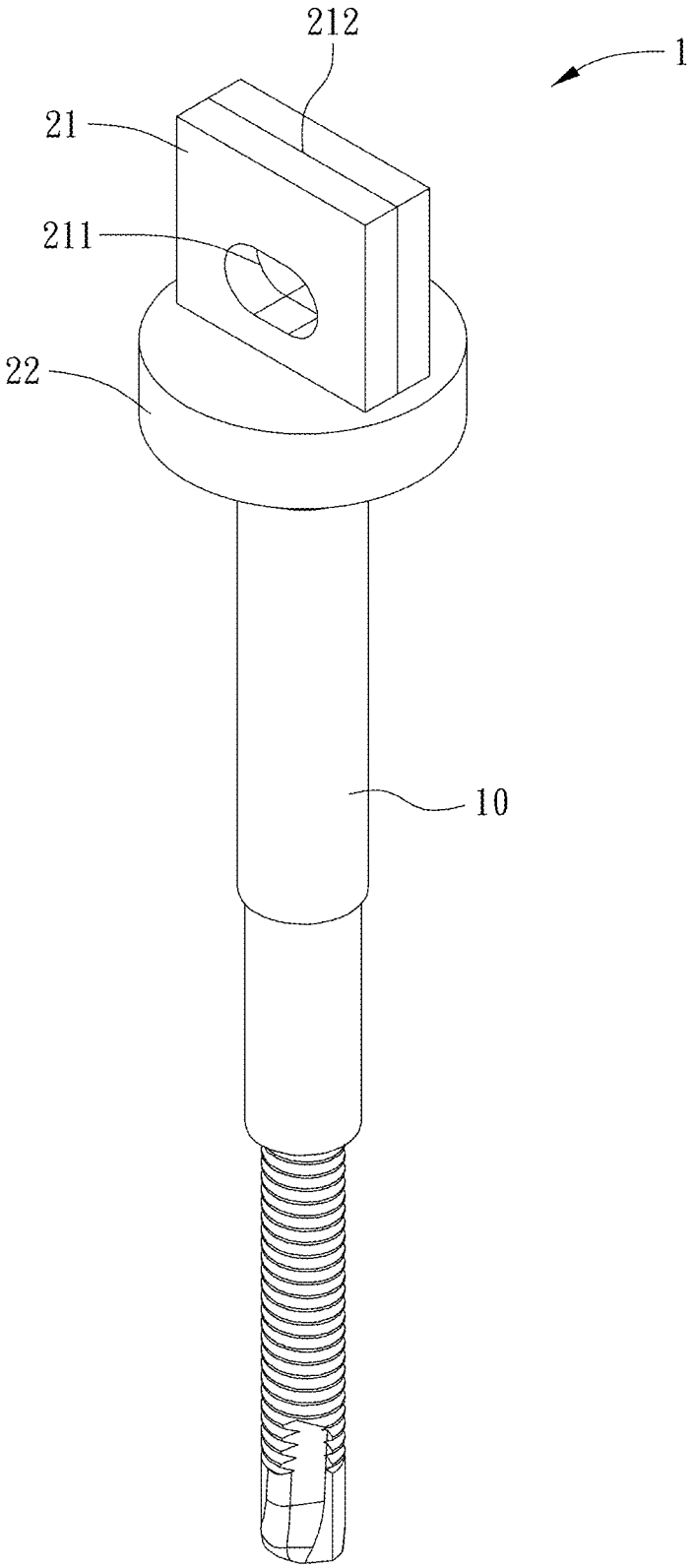
FIG. 1 is a stereogram of a preferable embodiment of the present invention.

Please refer to FIGS. 1 to 4 for a preferable embodiment of the present invention. A wall anchor 1 of the present invention includes a main body 10 and a sleeve member 20.

The main body 10 extends in a rod shape and includes a head portion 11, a body portion 12 and a radial flange 13 located between the head portion 11 and the body portion 12. The body portion 12 has an outer threaded segment 121, and the radial flange 13 has a non-circular cross-sectional profile. The sleeve member 20 includes a first portion 21 and a second portion 22. The first portion 21 is coveringly disposed on an outer surface of the head portion 11, and the second portion 22 is coveringly disposed on an outer surface of the radial flange 13 and has a circular cross-sectional profile. Therefore, the outer threaded segment 121 is configured to be drilled into a mounting surface (such as a concrete wall or steel plate), and when the head portion 11 is driven by a tool, the sleeve member 20 is not easy to be rotated relative to the main body 10 so as to have good structural stability. The sleeve member 20 prevents the head portion 11 from being exposed outwardly and covers gaps between the mounting surface and the main body 10, which can reduce the transfer of heat and moisture.

Figure 3:
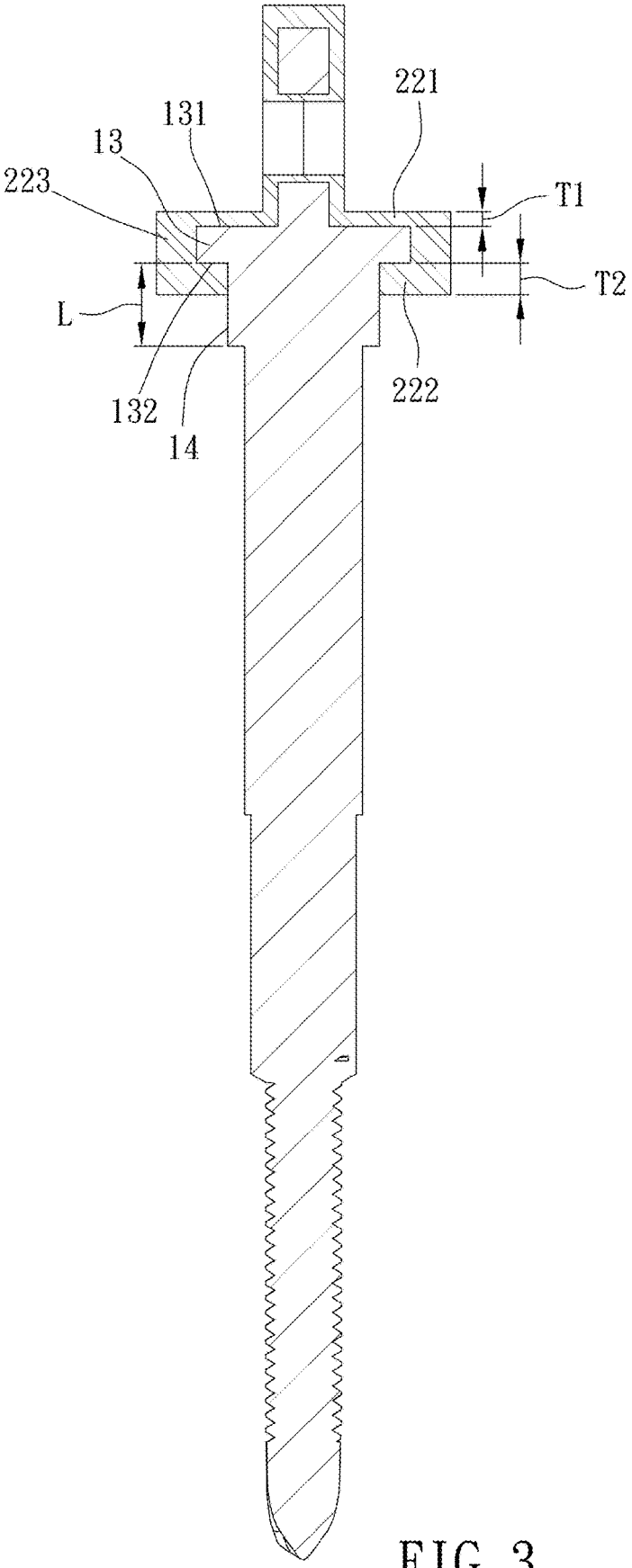
FIG. 3 is a cross sectional view of a preferable embodiment of the present invention.

Specifically, the radial flange 13 includes an upper surface 131 close to the head portion 11 and a lower surface 132 opposite to the upper surface 131, and the second portion 22 includes a first annular surface 221 facing the upper surface 131 and a second annular surface 222 facing the lower surface 132. A thickness T2 of the second annular surface 222 is greater than a thickness T1 of the first annular surface 221, as shown in FIG. 3. Preferably, the thickness T2 of the second annular surface 222 is at least 2 times of the thickness T1 of the first annular surface 221 so that the second annular surface 222 is thick enough to provide good heat insulation effect. When the wall anchor 1 is screwing into the mounting surface, the second annular surface 222 is not easy to be worn and damaged.

Figure 2:
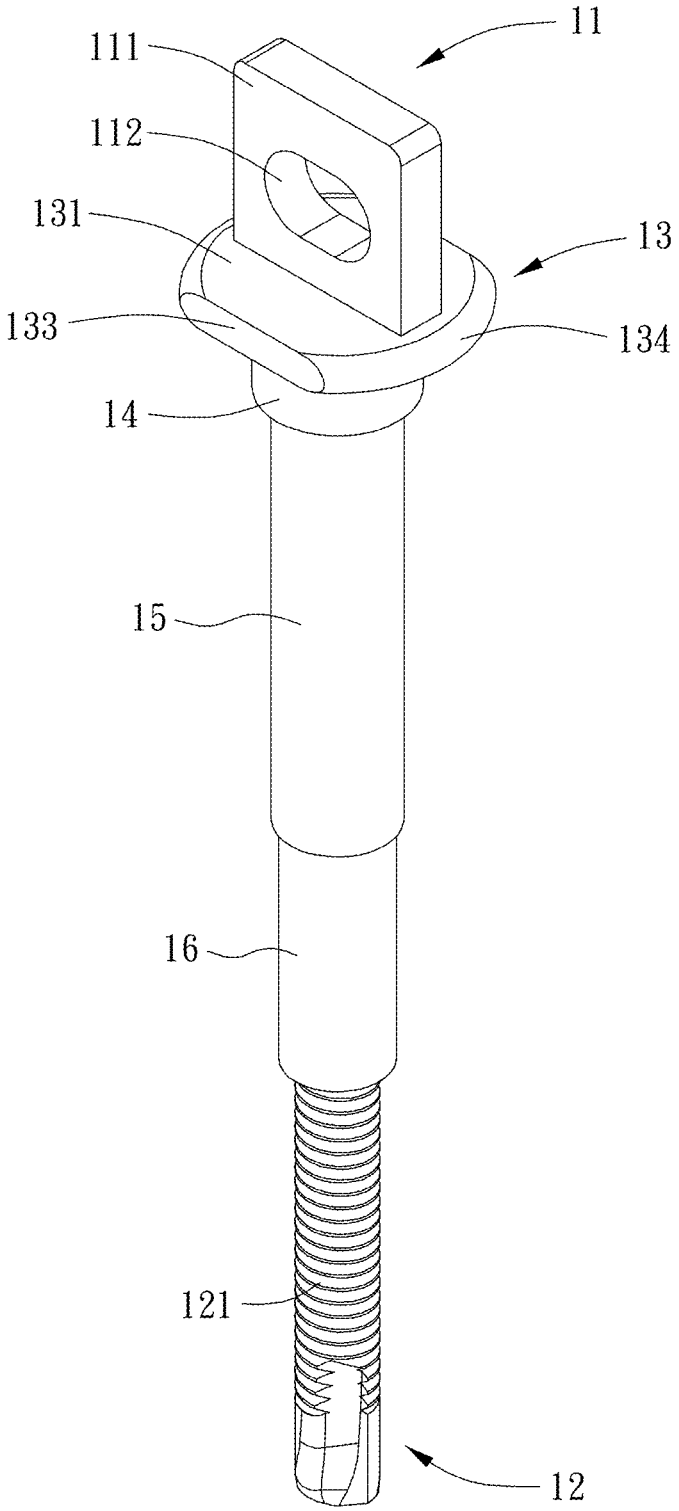
FIG. 2 is a stereogram of a main body according to a preferable embodiment of the present invention.
Figure 4:
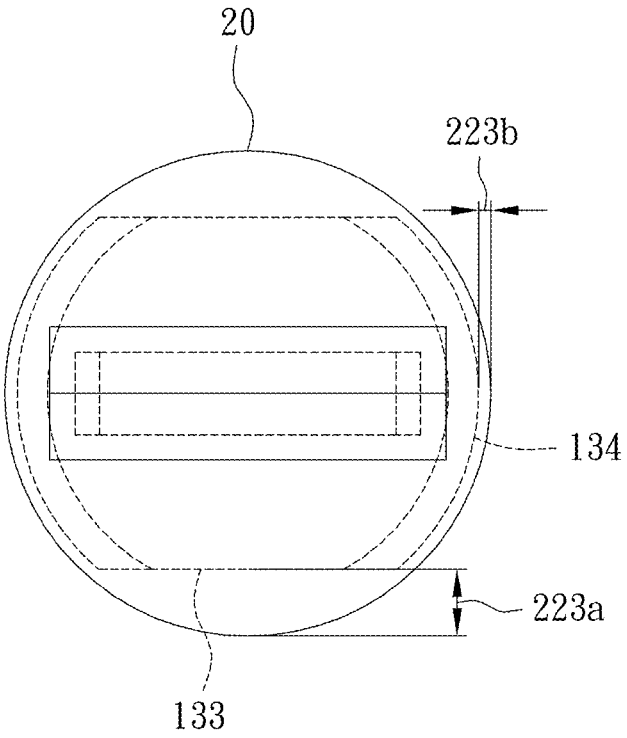
FIG. 4 is a top view of a preferable embodiment of the present invention.

Please refer to FIGS. 2 and 4, the radial flange 13 includes at least one flat surface 133 and at least one arcuate surface 134, and the second portion 22 includes a circumferential wall 223 coveringly disposed on the at least one flat surface 133 and the at least one arcuate surface 134. As viewed in an axial direction of the main body 10, a portion of the circumferential wall 223 facing the at least one flat surface 133 has a first thickness 223*a*, and a portion of the circumferential wall 223 facing the at least one arcuate surface 134 has a second thickness 223*b* smaller than the first thickness 223*a*. In this embodiment, the radial flange 13 includes two said flat surfaces 133 and two said arcuate surfaces 134, and the two said flat surfaces 133 extend parallel to each other, which effectively prevents the sleeve member 20 from being rotated relative to the head portion 11. The first thickness 223*a* is preferably at least 3 times of the second thickness 223*b* so as to have good thermal insulation effect and provide good structural strength of the sleeve member 20.

The body portion 12 further includes a first segment 14, a second segment 15 and a third segment 16 which are sequentially arranged between the radial flange 13 and the outer threaded segment 121. A diametrical dimension of the first segment 14 is greater than a diametrical dimension of the second segment 15 which is greater than a diametrical dimension of the third segment 16, and the sleeve member 20 is spaced apart from the second segment 15. Therefore, the body portion 12 has different diametrical dimensions and can be radially abutted against layers on the mounting surface (such as heat insulation panels, sound insulation panels, building templates, etc.) for stable engagement. The radial flange 13 is adjacently connected with the first segment 14. In the axial direction of the main body 10, a thickness of the second portion 22 protruding beyond the radial flange 13 (that is, the thickness T2 of the second annular surface 222) is smaller than or equal to ½ of a length of the first segment 14, which allows the first segment 14 to be stably inserted within the layers on the mounting surface. Preferably, a diametrical dimension of the outer threaded segment 121 is smaller than a diametrical dimension of the third segment 16, and a length of the outer threaded segment 121 is greater than or equal to 2 cm. Therefore, the outer threaded segment 121 can be stably screwed into the mounting surface, and the third segment 16 is configured to be radially abutted against the layers on the mounting surface.

Moreover, the main body 10 is made of a zinc alloy material by die-casting, which provides good production precision, production efficiency and high structural strength. The zinc alloy material has a zinc content of at least 95.5 wt % and an aluminum content of at least 3.9 wt %. A hardness of the main body 10 is greater than a hardness of the sleeve member 20. Therefore, the main body 10 has good structural strength and is easy to be screwed into the mounting surface, and the sleeve member 20 can be urged and slightly deformed so as to tightly cover the gaps between the body portion 12 and the mounting surface and reduce heat exchange.

The sleeve member 20 is made of a nylon material, such as nylon 6, nylon 66, nylon composite materials, etc., so as to have good rigidity, toughness, chemical resistance and weather resistance. Therefore, the sleeve member 20 meets UL94-V0 requirements for flame resistance and is durable and safe. The head portion 11 has a lug 111 and a through hole 112 penetrating through the lug 111, and the first portion 21 completely covers the lug 111 and has an inner mold line 211 and an outer mold line 212 respectively extending in a circumferential direction of the through hole 112. A thickness of the lug 111 is greater than a thickness of the radial flange 13. Reasonably, the inner mold line 211 and the outer mold line 212 are weaker parts of the sleeve member 20, with the structures as described above, the sleeve member 20 is not easily damaged and peeled off and is durable to use.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A wall anchor, including:

a main body, extending in a rod shape, including a head portion, a body portion and a radial flange located between the head portion and the body portion, the body portion having an outer threaded segment, the radial flange having a non-circular cross-sectional profile; and a sleeve member, including a first portion and a second portion, the first portion coveringly disposed on an outer surface of the head portion, the second portion coveringly disposed on an outer surface of the radial flange and having a circular cross-sectional profile.

2. The wall anchor of claim 1, wherein the radial flange includes an upper surface close to the head portion and a lower surface opposite to the upper surface, the second portion includes a first annular surface facing the upper surface and a second annular surface facing the lower surface, and a thickness of the second annular surface is greater than a thickness of the first annular surface.

3. The wall anchor of claim 1, wherein the radial flange includes at least one flat surface and at least one arcuate surface, the second portion includes a circumferential wall coveringly disposed on the at least one flat surface and the at least one arcuate surface, as viewed in an axial direction of the main body, a portion of the circumferential wall facing the at least one flat surface has a first thickness, and a portion of the circumferential wall facing the at least one arcuate surface has a second thickness smaller than the first thickness.

4. The wall anchor of claim 3, wherein the first thickness is at least 3 times of the second thickness.

5. The wall anchor of claim 1, wherein the body portion further includes a first segment, a second segment and a third segment which are sequentially arranged between the radial flange and the outer threaded segment, a diametrical dimension of the first segment is greater than a diametrical dimension of the second segment which is greater than a diametrical dimension of the third segment, and the sleeve member is spaced apart from the second segment.

6. The wall anchor of claim 5, wherein the radial flange is adjacently connected with the first segment, in an axial direction of the main body, a thickness of the second portion protruding beyond the radial flange is smaller than or equal to ½ of a length of the first segment.

7. The wall anchor of claim 1, wherein the main body is made of a zinc alloy material by die-casting.

8. The wall anchor of claim 7, wherein the zinc alloy material has a zinc content of at least 95.5 wt % and an aluminum content of at least 3.9 wt %.

9. The wall anchor of claim 1, wherein the sleeve member is made of a nylon material, the head portion includes a lug and a through hole penetrating through the lug, and the first portion completely covers the lug and has an inner mold line and an outer mold line respectively extending in a circumferential direction of the through hole.

10. The wall anchor of claim 6, wherein the radial flange includes an upper surface close to the head portion and a lower surface opposite to the upper surface, the second portion includes a first annular surface facing the upper surface and a second annular surface facing the lower surface, and a thickness of the second annular surface is greater than a thickness of the first annular surface; the thickness of the second annular surface is at least 2 times of the thickness of the first annular surface; the radial flange includes two flat surfaces and two arcuate surfaces, the second portion includes a circumferential wall coveringly disposed on the two flat surfaces and the two arcuate surfaces, as viewed in the axial direction of the main body, a portion of the circumferential wall facing each of the two flat surfaces has a first thickness, and a portion of the circumferential wall facing each of the two arcuate surfaces has a second thickness smaller than the first thickness; the two flat surfaces extend parallel to each other; the first thickness is at least 3 times of the second thickness; the main body is made of a zinc alloy material by die-casting; the zinc alloy material has a zinc content of at least 95.5 wt % and an aluminum content of at least 3.9 wt %; the sleeve member is made of a nylon material, the head portion includes a lug and a through hole penetrating through the lug, and the first portion completely covers the lug and has an inner mold line and an outer mold line respectively extending in a circumferential direction of the through hole; a thickness of the lug is greater than a thickness of the radial flange; a hardness of the main body is greater than a hardness of the sleeve member; a diametrical dimension of the outer threaded segment is smaller than the diametrical dimension of the third segment; and a length of the outer threaded segment is greater than or equal to 2 cm.

* * * * *